US005216327A

United States Patent [19]

Myers et al.

[11] Patent Number: 5,216,327

[45] Date of Patent: Jun. 1, 1993

[54] MAGNETRON COAXIAL ADAPTOR HAVING A CAP WHICH FITS OVER THE MAGNETRON OUTPUT ANTENNA

[75] Inventors: Ira J. Myers, Natick; William C. Brown, Weston, both of Mass.

[73] Assignee: Raytheon Company, Lexington, Mass.

[21] Appl. No.: 810,624

[22] Filed: Dec. 19, 1991

[51] Int. Cl.[5] ..... H01J 23/48; H01J 25/50

[52] U.S. Cl. ..... 315/39.53; 333/260

[58] Field of Search ..... 315/39.53, 39.51; 333/260

[56] References Cited

U.S. PATENT DOCUMENTS

| | | | |
|---|---|---|---|
| 2,580,988 | 1/1952 | Anderson | 315/39.53 X |
| 2,906,921 | 9/1959 | Gardiner | 315/39.53 X |
| 3,334,266 | 8/1967 | Frutiger | 315/39.65 X |
| 3,448,331 | 6/1969 | Cook | 315/39.53 |
| 3,536,953 | 10/1970 | Van De Goor | 315/39.51 X |
| 3,579,282 | 5/1971 | Couper | 333/260 |
| 4,125,308 | 11/1978 | Schilling | 333/260 X |
| 4,672,342 | 6/1987 | Gartzke | 333/260 |

*Primary Examiner*—Robert J. Pascal
*Assistant Examiner*—Benny T. Lee
*Attorney, Agent, or Firm*—Denis G. Maloney; Richard M. Sharkansky

[57] ABSTRACT

An impedance matching coaxial adaptor for use with magnetron power sources having output coaxial probes includes an outer cylindrical housing disposed around a cylindrical inner housing. The inner housing is disposed along a common axis of the outer housing and includes a bore disposed within a first end of the inner housing for receiving an antenna-type probe element of a magnetron power source. The coaxial adaptor allow a magnetron source normally having an output probe for radiating into a waveguide to be used with a coaxial output.

10 Claims, 2 Drawing Sheets

MAGNETRON COAXIAL ADAPTOR HAVING A CAP WHICH FITS OVER THE MAGNETRON OUTPUT ANTENNA

BACKGROUND OF THE INVENTION

This invention relates generally to coaxial adaptors and more particularly to magnetron coaxial adaptors.

As is known in the art, a magnetron is a diode vacuum tube which has a magnetic field perpendicular to the electric field between a cathode and an anode electrode of the tube. A number of resonator cavities are disposed within the anode electrode in a cylindrical pattern around a cylindrically shaped cathode electrode. A permanent magnet is disposed around the anode electrode and cathode electrode to provide a magnetic field in a direction parallel to the axis of the tube. The resonant cavities generally have one of a number of cavity geometries as are known by ones of ordinary skill in the art, such as slotted, vaned or slotted-hole configurations.

In operation, power is provided to a heater disposed adjacent the cathode so that a surface of the cathode is raised to an elevated temperature to provide emission of electrons from the cathode surface. The emitted electrons are accelerated toward the anode electrode by the electrical field present between the anode and cathode electrodes. In some magnetron tubes, the cathode is directly heated whereas in other tubes a separate element is used to heat the cathode. The cathode is generally biased at a voltage potential less than that of the anode so that the negatively charged electrons are attracted toward the anode. The accelerated electrons, in passing through the constant and nearly uniform magnetic field are deflected such that energy is coupled to the resonator cavities within the anode block. The plurality of resonator cavities provides a periodic structure which oscillates at a frequency generally dependent on the geometry and dimensions of the cavity structures. The RF output power is extracted from one or more of the oscillating cavities generally by either a coaxial line output or a waveguide output.

For coaxial line outputs, a conductive cylindrical rod having a looped end portion is disposed within one of the cavities with a second end extending out of the magnetron housing. Coaxial line looped outputs are typically limited to lower power and lower frequency magnetron applications, since coaxial structures generally introduce greater insertion loss than waveguide structures. Moreover, in high power applications, there is a greater likelihood that voltage breakdown arcing will occur between the center and outer conductors.

On the other hand, waveguide outputs are typically used for higher power and higher frequency applications. For this type of output, power is extracted from a back wall of one of the cavities by means of a slit having dimensions which generally expand until the dimensions correspond to those of the output mating waveguide. Although a waveguide output generally provides a higher power handling and lower insertion loss transition for energy coupled out of the magnetron source, waveguide output magnetron sources for some applications may be undesirable because of their relative large size, bulk and cost.

Alternatively, a waveguide output magnetron may be provided by having the aforementioned coaxial line loop output disposed within a waveguide. In this configuration, the end of the cylindrical rod provides a probe which when inserted into a section of the waveguide converts the energy from a TEM mode to a waveguide mode, such as the $TE_{10}$ mode. The length of the portion of the probe which extends into the waveguide is typically about one quarter wavelength at the frequency of interest. A shorting plate is disposed at one end of the waveguide at an appropriate distance from the probe for providing maximum transmission of the energy to the output end of the waveguide.

For many applications it would be desirable to have a high power and low cost magnetron source having a relatively low loss transition from a coaxial output probe of the magnetron to a standard coaxial connector.

SUMMARY OF THE INVENTION

In accordance with the present invention, a magnetron coaxial adaptor includes a cylindrical member having a bore disposed within a first end of the member and a second end of the cylindrical member coupled to a center conductor of a coaxial connector. The magnetron coaxial adaptor further includes a housing disposed around the cylindrical member having an end portion coupled to an outer conductor of the coaxial connector with the bore of the cylindrical member being disposed over an output probe of a magnetron source. With such an arrangement, a magnetron coaxial adaptor may be coupled between the conventional magnetron source having an output probe and a coaxial connector. The magnetron coaxial adaptor receives the probe within a cylindrical member having a bore or cavity with dimensions for providing a relatively low impedance at a predetermined frequency. The cylindrical member is disposed coaxially within a cylindrical housing for providing an inner and outer conductor, respectively of a coaxial transmission line. The cylindrical member is coupled to a center conductor of a coaxial connector and the cylindrical housing is coupled to an outer conductor of the coaxial connector. The cylindrical member in combination with the cylindrical housing provides a relatively low impedance transition from the magnetron source probe to a conventional coaxial connector. Magnetron power sources having such coaxial outputs would be lower in cost than conventional coaxial output magnetron sources having waveguide to coaxial transmission lines and may be used in laboratory and manufacturing environments in a wide variety of applications.

BRIEF DESCRIPTION OF THE DRAWINGS

The foregoing features of this invention, as well as the invention itself, may be more fully understood from the following detailed description of the drawings, in which.

DESCRIPTION OF THE PREFERRED EMBODIMENTS

Figure 1:
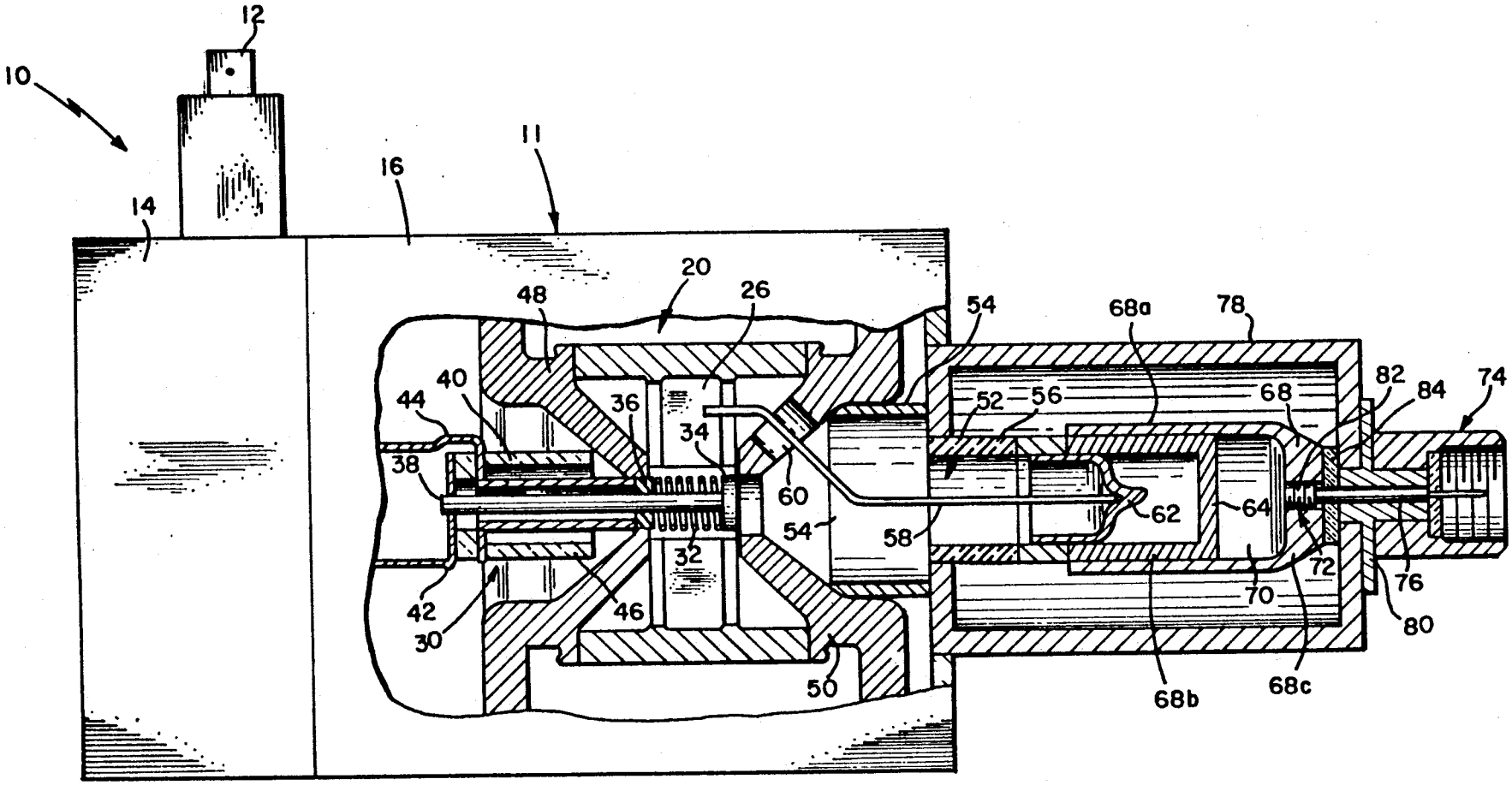
FIG. 1 is a cross-sectional view of a magnetron coaxial adaptor coupled between a magnetron power source having a coaxial coupling probe and a coaxial connector.

Referring now to FIG. 1, an R.F. power source 10 is shown to include an input connector 12, here a coaxial connector disposed on a power supply housing 14 of the magnetron power supply (not shown) disposed within the housing 14. The input connector 12 is electrically connected to a power source (not shown). The power supply housing 14 has appropriate filter and signal conditioning circuitry disposed within to condition power from connector 12 in an appropriate manner such that it can be effectively used by a magnetron tube 11.

Figure 2:
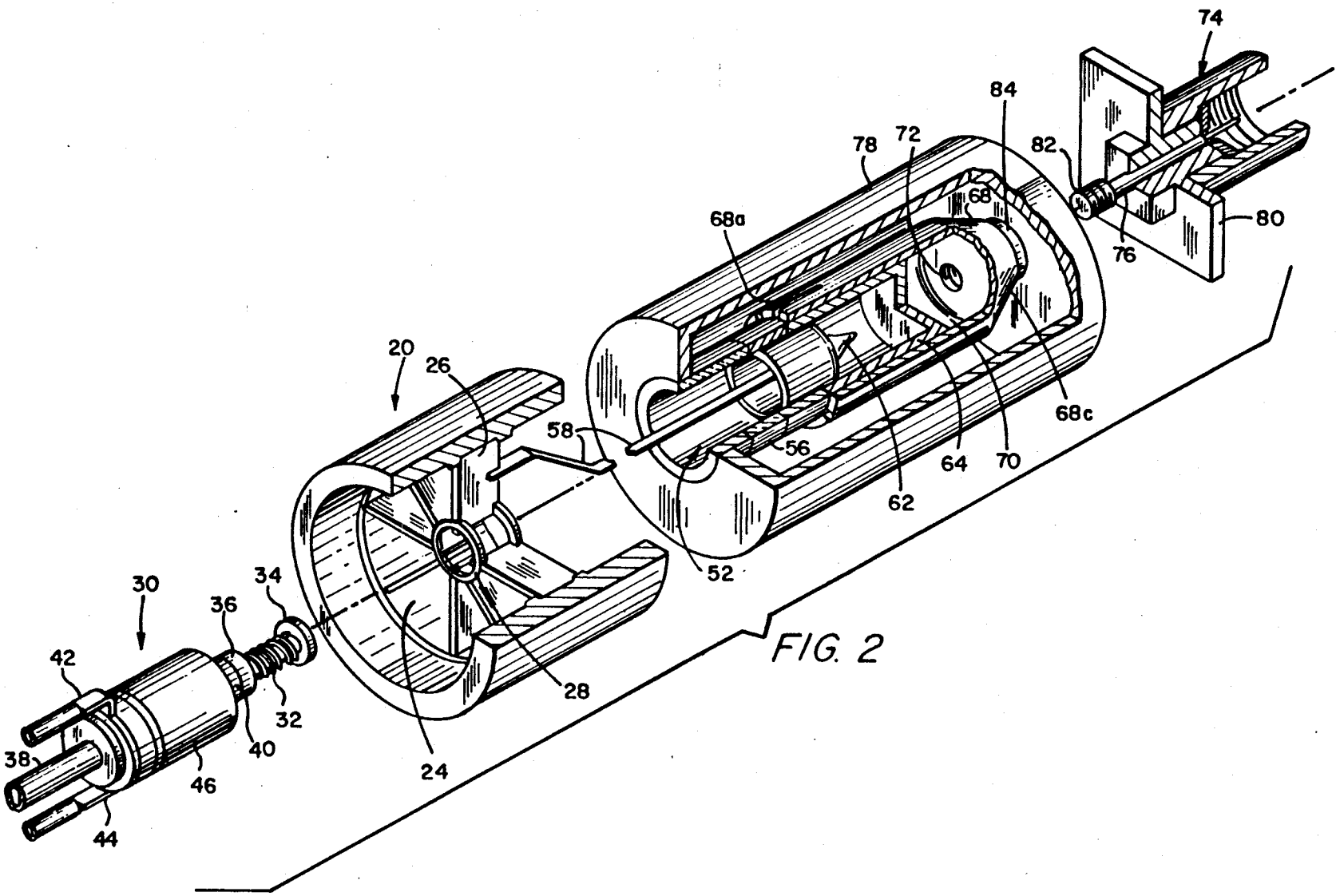
FIG. 2 is an isometric and exploded view, partially broken away of a portion of the magnetron power source having the magnetron coaxial adaptor.

The magnetron tube 11 further includes a magnetron housing 16 attached to the power supply housing 14. A magnetron tube 11 is disposed within the magnetron housing 16 and includes a cylindrical conductive anode block electrode 20 having a plurality of circumferentially disposed cavity resonators 24 (FIG. 2). Walls of the cavity resonators are defined by a plurality of vane elements 26 which radially extend from a center portion to an outer wall of the cylindrical anode block 20. The inner ends of the extending vanes 26 are alternately interconnected by ring-like straps 28 (FIG. 2) as are well known by those of ordinary skill in the art.

Referring now to FIGS. 1 and 2, a cathode assembly 30 is disposed in axial alignment with an axis of the anode and in a space defined by the inner ends of the vanes 26. The cathode assembly 30 includes a directly heated coiled filament 32, generally fabricated from high temperature metals known for use as electron emitters, such as oxide coated molybdenum or thoriated tungsten. Filament 32 is connected at its upper and lower ends to end shields 34 and 36, respectively. Upper end shield 34 is connected to a metal central support rod 38 and lower end shield 34 is connected to a metal cylinder 40. Support rod 38 and cylinder 40 are both disposed through a high voltage insulating cylinder 46 and are connected to respective metal ring washers 42 and 44. Metal ring washers 42 and 44 provide electrical connection points to the filament 32. The voltage insulating cylinder 46 is disposed at an end portion of the cathode assembly and is bonded at one end to a first one of a pair of magnetic pole pieces 48, 50 (see FIG. 1). Referring now to FIG. 1, the first one of the pair of magnetic pole pieces 48 is bonded to anode element block 20 and has an aperture through which the cathode assembly 30 is supported in the interactive space adjacent the inner ends of the vanes 26. A second one of the pair of magnetic pole pieces 50 is sealed to the upper end of the anode element block 20. Conventional permanent magnet structure is disposed around the anode block 20, to provide a magnetic field between poles pieces 48 and 50 and may comprise, in a preferred embodiment, an annular permanent magnet with a magnetic return path.

An output circuit 52 extends from the second one of the pair of magnetic pole pieces 50 and includes a metal cylinder 54 (see FIG. 1) attached to the pole piece 50 at a first end and attached to a ceramic cylinder 56 which provides electrical isolation between an output antenna 58 and the metal cylinder 54. The output antenna 58 is connected to the upper edge of one of the vanes 26 and extends through an aperture 60 (see FIG. 1) in magnetic pole piece 50. The antenna 58 further extends through cylinder 54 and ceramic cylinder 56 to be held in place by a metal tubulation tip 62 through which the magnetron has been evacuated and sealed. The tubulation tip 62 is covered by a metal ca 64 bonded to tubulation tip 62.

A cylindrical member 68 is disposed over the metal cap 64 and has a bore 70 with dimensions substantially equivalent to outer dimensions of the metal cap 64 for providing a relatively tight fit at a first end. In a preferred embodiment, the cylindrical member 68 has a plurality of longitudinal slots **68*a* disposed through a portion of the first end of the cylindrical member 68 with said slots having a length such that the cylindrical member 68 provides the region of the member between the slots 68*a* as a plurality of spring-like finger members for tightly securing the member 68 to the metal cap 64. Cylindrical member 68 has a first portion 68*b* having a uniform outer diameter with the bore 70 disposed therein and a second cover portion 68*c* integrally coupled to the first portion 68*b* (see FIG. 1) having a second aperture 72 disposed therethrough for receiving a threaded stud 82 of coaxial connector 74. The second portion 68*c*, in a preferred embodiment, is tapered or bevelled from an outer diameter consistent with the uniform outer diameter of the first portion 68*b* to a smaller outer diameter. The tapered diameter provides impedance matching between the magnetron output circuit and coaxial connector 74 and will be discussed later. A coaxial connector 74 here, an N-type male type connector, manufactured by M/A-COM Inc., Omni Spectra Interconnect Division, Waltham, MA, Model No. 3052-1201-10 is modified to provide a center conductor 76 which is disposed within an aperture 72 disposed at a second end of the cylindrical member 68. In a preferred embodiment, the center conductor 76 of coaxial connector 74 is shortened and the metal threaded stud 82 is soldered to the center conductor so that the connector may be screwed into the correspondingly threaded aperture 72 of the cylindrical member 68. Coaxial connector 74 alternatively, may be any of a variety of conventional coaxial connectors, known by those of ordinary skill in the art such as, LN or SMA type connectors. Disposed around cylindrical member 68 is a cylindrical housing 78 having a first end coupled to the metal cylinder 54 and a second end coupled to an outer conductor 80 of coaxial connector 74. An isolating washer 84 fabricated from a non-conductive material is disposed between the second end of the cylindrical member 68 and the outer conductor 80 of the coaxial connector 74 to electrically isolate the outer conductor 80 from the cylindrical member 68**.

The cylindrical member 68 is disposed within housing 78 such that a coaxial transmission line is provided between magnetron power source 10 and output coaxial connector 74.

In operation of the magnetron power source 10, an electric field is generated by applying a high direct-current potential between the cathode assembly 30 and anode element block 20 via connector 12. A relatively strong magnetic field is concurrently provided in a direction normal to the cross section of the magnetron power source 10 by the permanent magnet structure. Electrons emitted from the filament 32 are accelerated toward the anode element block 20 but have their trajectories deflected by the presence of the magnetic field which causes the electrons to move in a spiral path before striking the end shield 34 of the cathode assembly 30. As the clouds of electrons spiral past the cavity resonator structures 24, the resonators are set into a mode of oscillation. The dimensions of the cavity resonator structures 24 are chosen to provide the desired frequency of the generated radio frequency signal. The RF signal is coupled out of the cavity resonator through output antenna 58 which is then coupled through tubulation tip 62 to the metal cap 64.

Magnetron power sources having this type of structure and operated in this manner are often used in microwave ovens for cooking food. In this application, the magnetron power source 10 is coupled to the oven cavity through a waveguide structure. The metal cap 64 generally extends through a broad wall of the waveguide and acts as an antenna, common in many coaxial to waveguide transitions. The waveguide generally has one end shorted by a plate and the other end coupled to an aperture in either the upper or lower wall of the cavity.

In using magnetron power sources of this type for applications requiring coaxial outputs, a waveguide structure is often coupled to the source in the same manner as described above in conjunction with the microwave oven. However, an additional shorting plate would generally be provided to the second end of the waveguide and a conventional waveguide to coaxial transmission line transition is disposed in the waveguide for coupling the microwave energy out of the waveguide. However, a magnetron antenna/waveguide/-coaxial line transition of this type may be undesirable since the intermediate waveguide transmission medium adds to the size, bulk, and cost of the source.

The coaxial adaptor, in accordance with the present invention includes the cylindrical member 68 for providing a center conductor of the adaptor and an outer cylindrical housing 78 disposed coaxial to cylindrical member 68 to provide an outer conductor portion of the coaxial adaptor structure. The cylindrical member here, has an inner diameter of 0.600 inches and an outer diameter of 0.750 inches. The output circuit 52, when encapsulated by the tubulation tube 62 and metal cap 64, has an impedance of approximately 50 ohms. Further, the coaxial connector 74 is generally desired to have an impedance of 50 ohms. Accordingly, it is desired that the coaxial adaptor have an impedance of 50 ohms in order to provide maximum transmission of the microwave energy from the magnetron source 10 to the coaxial connector 74. As is known by those of ordinary skill in the art, the characteristic impedance of a coaxial transmission line is expressed as $$Z_0 = 60\sqrt{\frac{\mu_r}{\epsilon_r}}\ \ln(b/a)$$

where:

$\mu_r$=relative permeability of transmission medium $\epsilon_r$=relative permittivity of transmission medium b=outer conductor diameter a=inner conductor diameter The transmission medium here, is air, which has a relative permeability and relative permittivity of 1.0. As mentioned earlier, the inner conductor has a diameter of 0.750 inches. In order to provide a coaxial adaptor with an impedance of 50 ohms, the inner diameter of the housing 78 is required to be 1.73 inches. Referring to FIG. 1, the second end of the cylindrical member 68*c* coupled to coaxial connector 74 is shown to be beveled in order to reduce any impedance mismatch at the transition and to provide maximum power transmission to the coaxial connector 74.

Having described preferred embodiments of the invention, it will now become apparent to one of skill in the art that other embodiments incorporating their concepts may be used. It is felt, therefore, that these embodiments should not be limited to disclosed embodiments, but rather should be limited only by the spirit and scope of the appended claims.

What is claimed is:

1. A magnetron coaxial adaptor, comprising:

a cylindrical member having a first end with an opening and a bore extending into said member from said first end and a plurality of longitudinal slots disposed through a portion of said first end to provide a plurality of finger members and a second end of said cylindrical member coupled to a center conductor of a coaxial connector;

a housing being coaxial with and electrically insulated from said cylindrical member, said housing having an end portion coupled to an outer conductor of said coaxial connector; and a metal cap being secured to an end of an output probe of a magnetron source; and said metal cap being disposed with said bore and secured to said cylindrical member by said finger members.

2. The magnetron coaxial adaptor, as recited in claim 1 wherein said housing is cylindrical in shape.

3. The magnetron coaxial adaptor, as recited in claim 2 wherein said first end of said cylindrical member has a first diameter and said second end of said cylindrical member has a second diameter different than said first diameter.

4. The magnetron coaxial adaptor, as recited in claim 3 wherein said coaxial connector has an impedance of 50Ω.

5. A magnetron output circuit comprising:

a magnetron output antenna;

a cylindrical member having a first end with an opening and a bore extending into said member from said first end and a plurality of longitudinal slots disposed through a portion of said first end to provide a plurality of finger members, and a second end of said cylindrical member coupled to a center conductor of a coaxial connector;

a cylindrical housing being coaxial with and electrically insulated from said cylindrical member, said housing having an end portion coupled to an outer conductor of said coaxial connector;

a metal cap being secured to an end of said magnetron output antenna; and said metal cap being disposed within said bore and secured to said cylindrical member by said finger members.

6. The magnetron output circuit, as recited in claim 5 wherein the first end of said cylindrical member has a first diameter and said second end of said cylindrical member has a second diameter different than said first diameter.

7. The magnetron output circuit, as recited in claim 6 wherein said coaxial connector has an impedance of 50 ohms.

8. A radio frequency apparatus having an anode, comprising:

an output antenna having a first end coupled to said anode;

a cylindrical member having a first end with an opening and a bore extending into said member from said first end and a plurality of longitudinal slots disposed through a portion of said first end to provide a plurality of finger members, and a second end of said cylindrical member coupled to a center conductor of a coaxial connector;

a cylindrical housing being coaxial with and electrically insulated from said cylindrical member, said housing having an end portion coupled to an outer conductor of said coaxial connector;

a metal cap being secured to a second end of said output antenna; and said metal cap being disposed within said bore and secured to said cylindrical member by said finger members.

9. The radio frequency power source, as recited in claim 8 wherein said first end of said cylindrical member has a first diameter and said second end of said cylindrical member has a second diameter different than said first diameter.

10. The radio frequency power source, as recited in claim 9 wherein said coaxial connector has an impedance of 50 ohms.

* * * * *